US006112904A

United States Patent [19]

Ajo

[11] Patent Number: 6,112,904

[45] Date of Patent: Sep. 5, 2000

[54] DEVICE AND METHOD IN HANDLING OF RETURNABLE PACKAGES

[75] Inventor: Jukka Ajo, Lahti, Finland

[73] Assignee: Halton System Oy, Heinola, Finland

[21] Appl. No.: 09/011,331

[22] PCT Filed: May 30, 1997

[86] PCT No.: PCT/FI97/00335

§ 371 Date: Feb. 5, 1998

§ 102(e) Date: Feb. 5, 1998

[87] PCT Pub. No.: WO97/46372

PCT Pub. Date: Dec. 11, 1997

[30] Foreign Application Priority Data

Jun. 5, 1995 [FI] Finland ..... 962337

[51] Int. Cl.[7] ..... B07C 5/00

[52] U.S. Cl. ..... 209/523; 209/522; 209/524; 100/902

[58] Field of Search ..... 209/522, 523, 209/524; 100/902

[56] References Cited

U.S. PATENT DOCUMENTS

| | | | |
|---|---|---|---|
| 4,285,426 | 8/1981 | Cahill | 194/4 C |
| 4,512,253 | 4/1985 | La Barge et al. | 100/53 |
| 4,519,306 | 5/1985 | LaBarge et al. | 100/35 |
| 4,519,307 | 5/1985 | La Barge et al. | 100/99 |
| 5,133,124 | 7/1992 | Burroughs | 100/902 X |
| 5,154,276 | 10/1992 | Lehtola | 198/457 |
| 5,248,102 | 9/1993 | Bohn | 241/99 |
| 5,423,492 | 6/1995 | Willis | 241/81 |

FOREIGN PATENT DOCUMENTS

| | | | |
|---|---|---|---|
| 86835 | 3/1991 | Finland . | |
| 19508388 | 9/1996 | Germany . | |
| 19512579 | 10/1996 | Germany . | |
| 9005346 | 5/1990 | WIPO . | |
| 9205523 | 4/1992 | WIPO | G07F 7/06 |

*Primary Examiner*—Donald P. Walsh
*Assistant Examiner*—Brett C. Martin
*Attorney, Agent, or Firm*—Steinberg, Raskin & Liberchuk, P.C.

[57] ABSTRACT

The invention concerns a device and a method in handling of returnable packages, such as bottles and/or cans. The device (10) comprises a rotatable magazine (12) for transferring returnable packages, such as bottles or cans, from a feed station ($B_1$) further. The device that transfers the returned package from the package feed station ($B_1$) is a rotatable magazine (12), which includes package spaces ($A_1$, $A_2$). The solution of equipment comprises, in the magazine (12), an outer wall, which moves to ahead of the feed gate ($B_1$) when the magazine is rotated. The identification station ($B_2$), in which the returned package, such as a can or a bottle, is identified, is placed after the feed station ($B_1$). The equipment includes means by which a returned package placed in a package space ($A_1$ or $A_2$) in the magazine (12) is transferred, by rotating the magazine, from the feed station ($B_1$) into the identification station ($B_2$), in which the returned package is identified. In the arrangement of equipment, there is a stattion into which the returned package is transferred if it has been accepted in the identification station ($B_2$). The device comprises such a control of the magazine (12) that the returned package, such as a can or a bottle, if it is not accepted upon identification carried out in the identification station ($B_2$), is transferred back into the feed station ($B_1$) by rotating the magazine (12).

22 Claims, 11 Drawing Sheets

DEVICE AND METHOD IN HANDLING OF RETURNABLE PACKAGES

FIELD OF THE INVENTION

The invention concerns a device and a method in handling of returnable packages, such as recycling bottles and/or cans.

BACKGROUND OF THE INVENTION

From the prior art, devices for handling of recycling cans are known, in which the recycling can, which is carried by a conveyor, is brought into connection with a scanning device, which reads the code (preferably bar code) provided on the face of the recycling package and, based on said code reading, gives the refund money or the corresponding receipt for the recycling or, in general, states the sum of money corresponding to the returned packages or the number of recycled units. In the solution of equipment, in a way in itself known, the returned package is rotated on a disk, in which connection the bar code enters within reach of the scanning beam.

OBJECTS AND SUMMARY OF THE INVENTION

In the solution of equipment in accordance with the invention, the recycling package is inserted into the intake opening, i.e. into the feed station, in the machine, from which the package is after this transferred into an identification station, which comprises a device that identifies the recycled package in the identification station. As the device that identifies the recycled package, it is possible to use, for example, a scanner that reads a bar code.

In the solution of equipment in accordance with the present invention, the package, such as a bottle or a can, is identified in an identification station placed after the feed station, and if the package is accepted, it is fed further, and if the package is not identified or accepted on the basis of identification carried out in the identification station, it is returned back into the feed station.

In the solution in accordance with the present invention, a rotatable magazine is employed. The further processing can comprise, for example, a package crusher, in which case the package is dropped into the crusher. In such a case, the package is crushed or, in general, brought into smaller volume for storage. In the solution, the space below the device includes a storage container, for example a removable sack.

In the solution in accordance with the present invention, the weight of the returned package is also measured in order that a full package should not move further in the process to be pressed by the press. In the solution of the present invention, the feed station includes a weight detector equipment, which reports the presence of a full package on the measurement base when the limit switch is being activated. The measurement base rests against springs with a spring force, and when a certain weight is surpassed, the measurement base moves downwards and acts upon a limit switch. The information on this is passed into the central unit, which does not accept the returned package. In this connection a signal lamp is switched on, and the person who is returning the package can take the non-accepted package back out of connection with the device.

In the solution of the present invention, a what is called rotatable magazine is used, which preferably comprises just two package receiving spaces or package spaces at opposite sides of the magazine construction. The receiving space is preferably a construction that comprises a vertical curved wall shaped as an arc of a circle, into which space the returnable package, a bottle/can can be placed, the package being moved by means of the walls of said space and supported by said walls, by rotating the magazine, into a second circumferential station, which is the scanning station in the way described above. After the scanning station there is the dropping station, which is placed at the opposite side of the central axis $X_1$ of the magazine, in relation to the package intake station. When the package is transferred into the scanning station, the wall of the magazine closes the feed station $B_1$ and prevents feeding of packages into connection with the magazine during scanning. In a situation of failure, the central unit 100 also shifts the magazine into a position in which the curved outer wall of the magazine prevents feeding of packages into the package stations $A_1$ or $A_2$. In the feed station $B_1$, the device in accordance with the invention can include a material identification detector underneath the weight sensing base made of plastic, which detector reports the detected material data of the returned package to the central unit 100. Thus, if the material of the package is not accepted in the central unit 100, the package is not shifted further from the feed station $B_1$. If the package is not accepted in this stage, such a mode of operation is possible that the magazine is rotated by means of the motor of the magazine in the direction opposite to the previous sense of transfer through 90° and the rejected returned package, such as a can, is transferred back into the intake station, i.e. the feed station $B_1$. If the package is accepted after code reading and after the preceding identification of weight, the package is transferred further by transferring the magazine 90° forwards in the original sense or rotation, in which connection the package falls down through the dropping station $B_3$, placed at the side opposite to the feed station $B_1$, into the press placed below and through the press into the storage space for compressed packages.

In the construction in accordance with the present invention, the magazine comprises two package receiving spaces or package spaces $A_1$,$A_2$. It is also typical of the invention that said receiving spaces $A_1$,$A_2$ are placed exactly at opposite sides of the magazine. Thus, in the construction of the present invention, it is favourably possible to employ turning angles of 90° from one station to the other.

The solution of equipment in accordance with the present invention further includes taking of the drive of the disk that is rotated from the press. Preferably a friction wheel is employed, which is engaged with the drum of the press, in which case the friction wheel and its shaft and further the disk are rotated by means of the drum of the press. Thus, for the rotation of the disk used for scanning, no separate rotating motor is required, but the rotation drive is taken from the drive motor of the press.

The invention is characterized in what is stated in the patent claims.

BRIEF DESCRIPTION OF THE DRAWINGS

The invention will be described in the following with reference to some preferred embodiments of the invention illustrated in the figures in the accompanying drawings, the invention being, however, not supposed to be confined to said embodiments alone.

DETAILED DESCRIPTION OF THE INVENTION

Figure 1A:
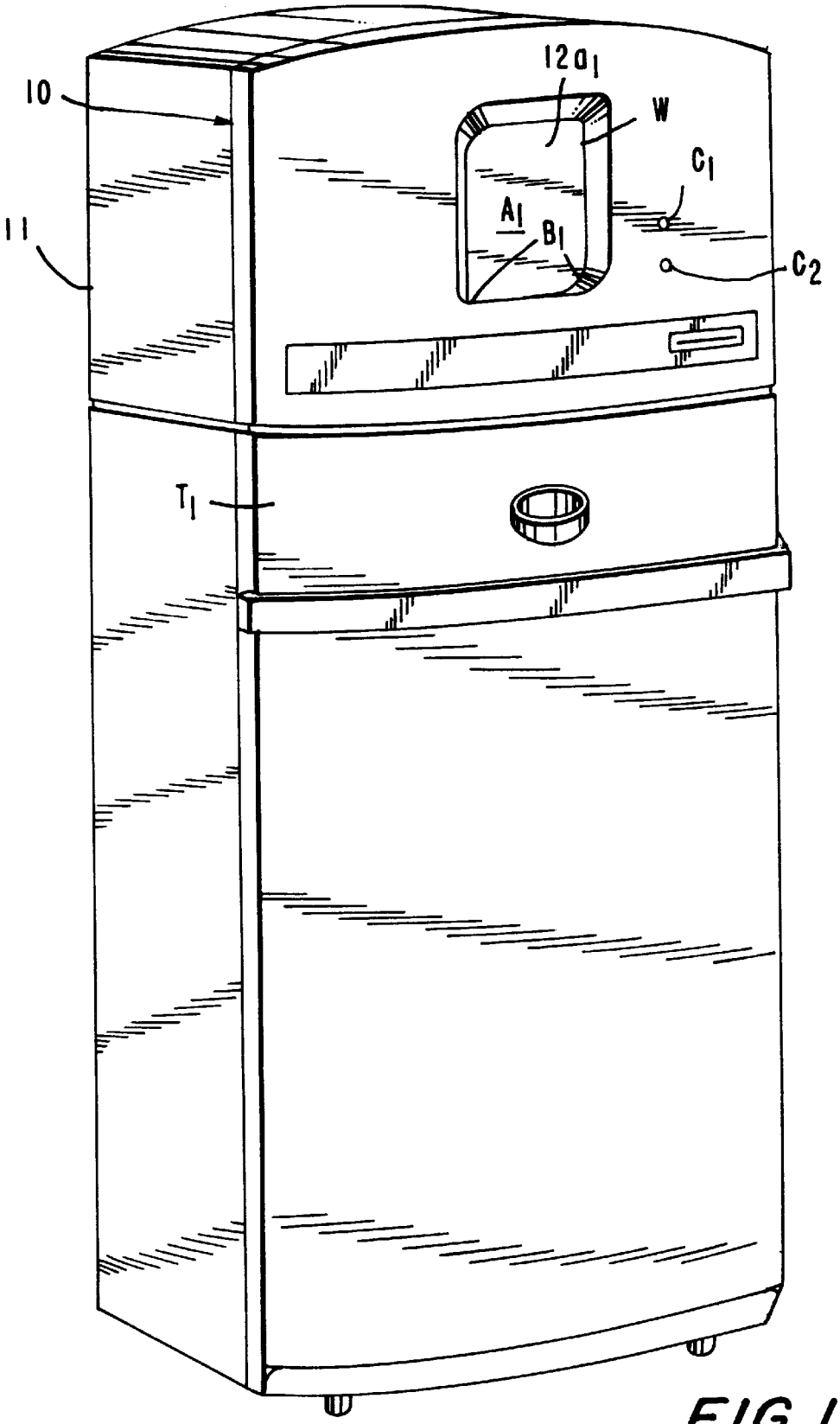
FIG. 1A is an axonometric view of a device in accordance with the invention viewed from the front.

FIG. 1A shows the return automat 10, which receives bottles, such as plastic bottles, and/or cans as returnable packages. In a preferred embodiment of the invention, the automat presses or crushes the empty recycling packages into smaller volume. As is shown in FIG. 1A, the construction comprises a box frame 11, in connection with whose front panel $T_1$ there is the feed station, i.e. the feed gate $B_1$, into which the returnable packages are placed on the base plate 20 (FIG. 2B), preferably on the measurement base 19 of the base plate 20. The measurement base 19 includes a limit switch 192, which detects the insertion of a non-empty return package into the feed station $B_1$ (FIG. 6B), in which connection a signal lamp $C_1$ is switched on in connection with the front panel $T_1$ and tells the returning person that the returned package has not been accepted. In such a case the returning person can remove the returned package from the feed station $B_1$. If the package is accepted, the returned package is transferred further by means of the rotatable magazine 12 into the scanning station $B_2$, in which the bar code provided on the face of the returned package, such as a can, is identified and, based on said number, the central unit 100 gives a receipt/money corresponding to the returned package or any other document of statement of the returned package.

As is shown in FIG. 1A, the box frame 11 that surrounds the device 10 includes an opening W in the feed station $B_1$. The can can be fed through the opening W into the package space $A_1$ in the magazine 12. After this the magazine 12 is rotated and the can transferred into the code reading station $B_2$, in which connection the curved wall 12*b* of the magazine 12 moves to the opening W in the box 11 and closes the feed station $B_1$.

FIGS. 1B to 1F are schematic illustrations of the operations of the device in accordance with the invention.

Figure 1B:
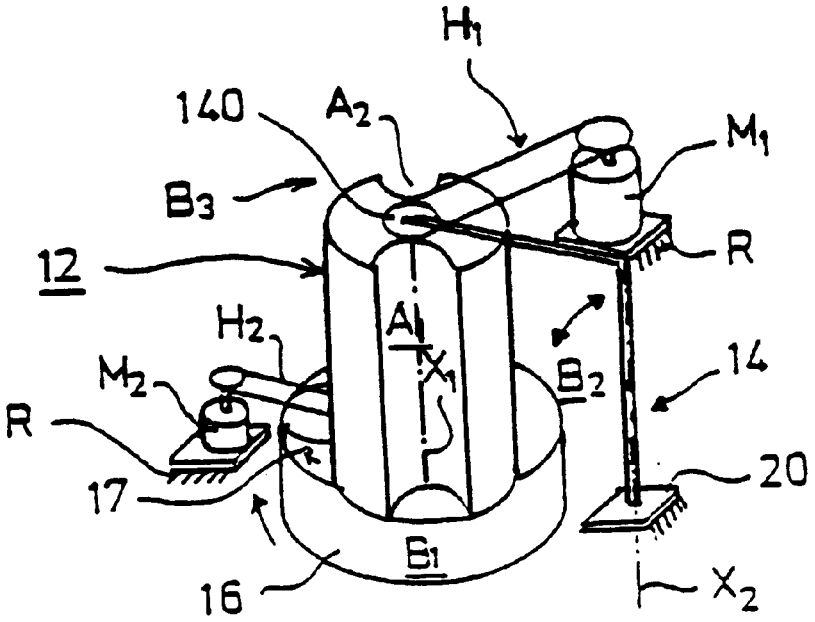
FIG. 1B is a schematic illustration of the unit of equipment.

FIG. 1B illustrates the basic units of operation in the device. The motor $M_1$ is fitted to rotate the magazine 12 in the device 10. The magazine 12 transfers the returned package from the feed station $B_1$ into the identification station $B_2$, in which the disk 18 rotated by the package processing device 15, preferably the press, rotates the returned package, in which connection the scanner or any other code reader 200 (preferably a bar code reader) placed at the side of the station ($B_2$) reads the code (preferably a bar code) provided on the side of the returned package. As is shown in FIG. 1B, the package processing device 15, preferably the press, i.e. its press drums 16 and 17, are driven by a separate motor $M_2$. Thus, in the solution of equipment in accordance with the invention, the scanning disk 18 is rotated by the same actuator $M_2$ as brings the rotation drive to the press drums 16,17 of the press 15. The magazine 12 is rotated by means of an actuator $M_1$, preferably an electric motor, by means of a transmission, preferably a belt transmission $H_1$, by bringing the rotation drive to the drive wheel 140 mounted on the axis $X_1$ of rotation of the magazine 12. The magazine 12 is mounted pivotally on a suspension device 14. Underneath, there is the press 15, which comprises a rotated outer drum 16 and a drum 17 placed in its interior, to which drum 17 the rotation drive is passed from the motor $M_2$ through the transmission $H_2$, preferably a drive pulley and a chain. The motor $M_2$ can be an electric motor. The equipment comprises a feed station $B_1$ in connection with the front panel $T_1$ of the device and a code reading station $B_2$ inside the front panel, and a dropping station $B_3$ placed with a phase shift of 90° after the reading station $B_2$, from which station $B_3$, after reading of the code, the identified package falls down into the press device 15.

Figure 1F:
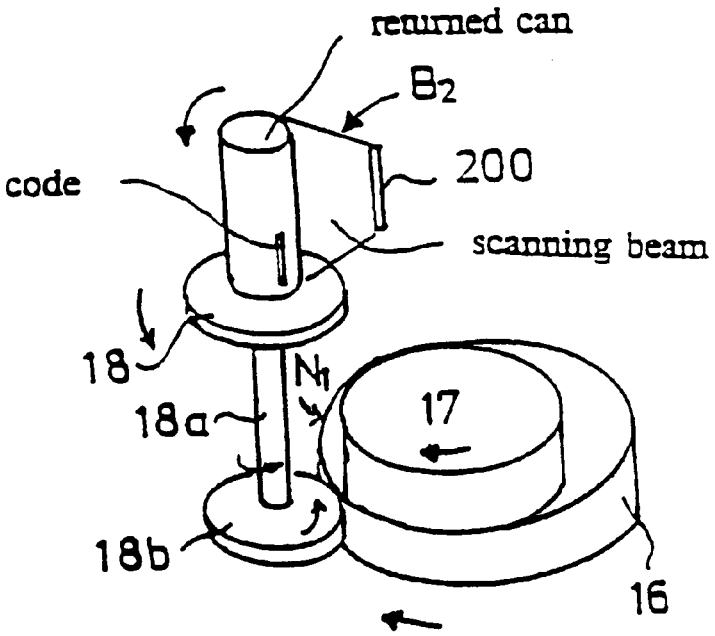
FIG. 1F illustrates the detecting of the bar code or equivalent provided on the side of a recycling package in the scanning station.
Figure 1C:
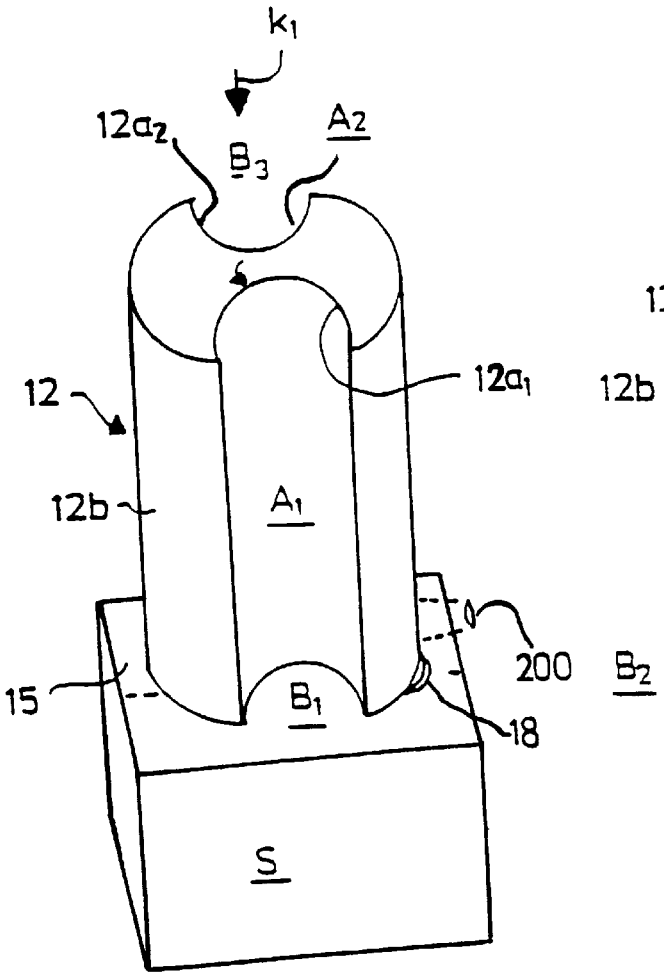
FIG. 1C illustrates the magazine that feeds the returnable packages in a device in accordance with the invention. Based on FIG. 1C, the basic operations of the rotatable magazine are described.

FIG. 1C illustrates the magazine. The magazine 12, which is rotated on the shaft 13 of the device, comprises two package spaces, the spaces $A_1$ and $A_2$, which are placed on the drum of the magazine at opposite sides of the drum. The returnable can/bottle is fed in the feed station $B_1$ into the space $A_1$ in the magazine 12, and the magazine 12 is rotated by means of the motor $M_1$ through 90°, at which angle the space $A_1$ in the magazine 12 is positioned in the station $B_2$ above the scanning disk 18 placed on the plane of the base plate 20. By means of the disk 18, the returned can/bottle is rotated, in which connection the scanner or any other code reader 200 reads the code, e.g. a bar code, provided on the side face of the returned package and reports said reading data to the central unit 100, which gives a receipt/refund money/any other document of statement corresponding to the returned package to the person who returned the package. The input station, i.e. feed station $B_1$, can be provided with sensing of weight, in which case the input station $B_1$ includes a measurement base 19 placed at the level of the base plate 20, said base 19 being fitted to be pivotal on a hinge device 190 against the spring force of a spring 191, in which connection, for example, a full package pivots the measurement base 19 against a limiter 192, the information concerning this being received in the central unit 100, in which case the returned package is not accepted. In such a case, a signal lamp $C_1$ is switched on in the top portion of the front panel $T_1$. The device can also include a device $C_2$ that produces a sound signal when a package is not accepted (FIG. 1A). When the returned package has been read on the scanning disk 18, it is shifted, by rotating the magazine 12 through 90°, into the station $B_3$, in which the returned package falls down through the opening 21$a_3$ in the base plate 20 into the press device 15.

Figure 1D:
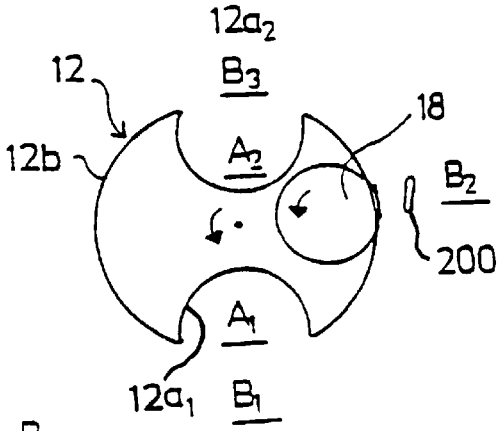
FIG. 1D shows the magazine viewed in the direction of the arrow $k_1$ in FIG. 1C.

FIG. 1D illustrates the solution of equipment of FIG. 1C viewed in the direction of the arrow $k_1$ in FIG. 1C.

Figure 1E:
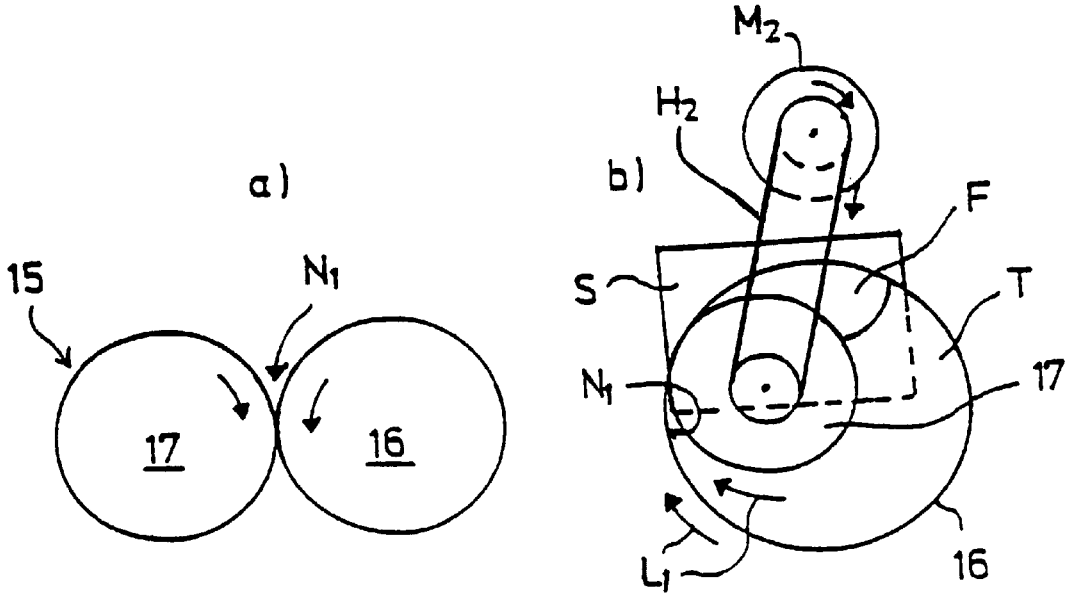
FIG. 1E illustrates different press solutions.

FIG. 1E shows various devices 15 for handling of returnable packages, preferably presses known in themselves. The embodiment a) of the processing device 15 shown in FIG. 1E comprises press drums 16 and 17, both of which are rotated. The embodiment b) shows a press, in which the outer drum 16 revolves in the direction $L_1$, i.e. in the same direction as the inner drum 17. The inner drum 17 is driven by a motor $M_2$, and the drum 17 is pressed against the inner face of the outer drum 16. Between the drums 16 and 17 a gap $N_1$ is formed, in which the returned package is wedged, being transferred, after the gap $N_1$, through the opening F in the base plate T of the device into the storage space S for pressed packages placed below.

FIG. 1F illustrates the drive of the scanning disk 18 taken from the outer circumference of the press drum 16. Thus, by means of the motor $M_2$ of the press drum 16,17, the scanning disk 18 is also driven at the same time.

Figure 2A:
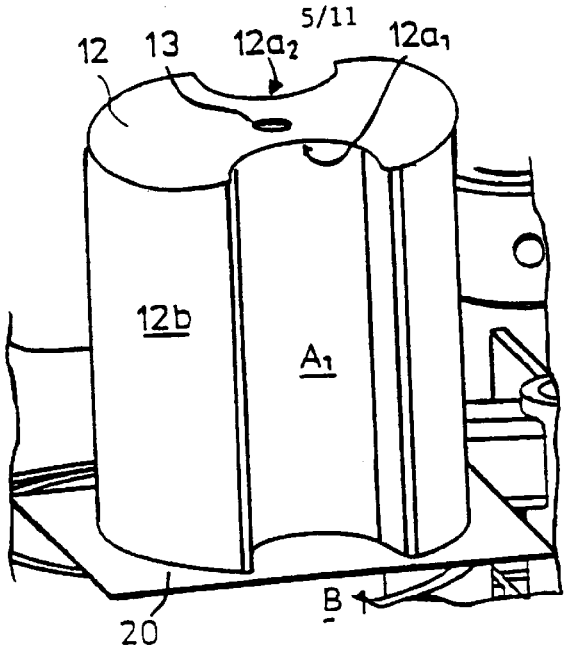
FIG. 2A is an axonometric view of a magazine in accordance with the invention.

FIG. 2A shows the magazine 12, which comprises a frame and therein package spaces $A_1$,$A_2$ at opposite sides of the magazine 12. The frame comprises curved vertical walls 12$a_1$, 12$a_2$ at the package spaces $A_1$, $A_2$, and further the magazine 12 comprises an outer curved wall 12$b$ on the magazine 12. Thus, when a package is returned, it is first placed into the station $B_1$ on the base plate 20, on the measurement base 19, and after this, if the returned package is accepted, the magazine 12 is rotated through 90° so that the returned package is transferred while guided by the vertical wall 12$a_1$ or 12$a_2$ of the package space $A_1$ or $A_2$ in the magazine 12.

Figure 2B:
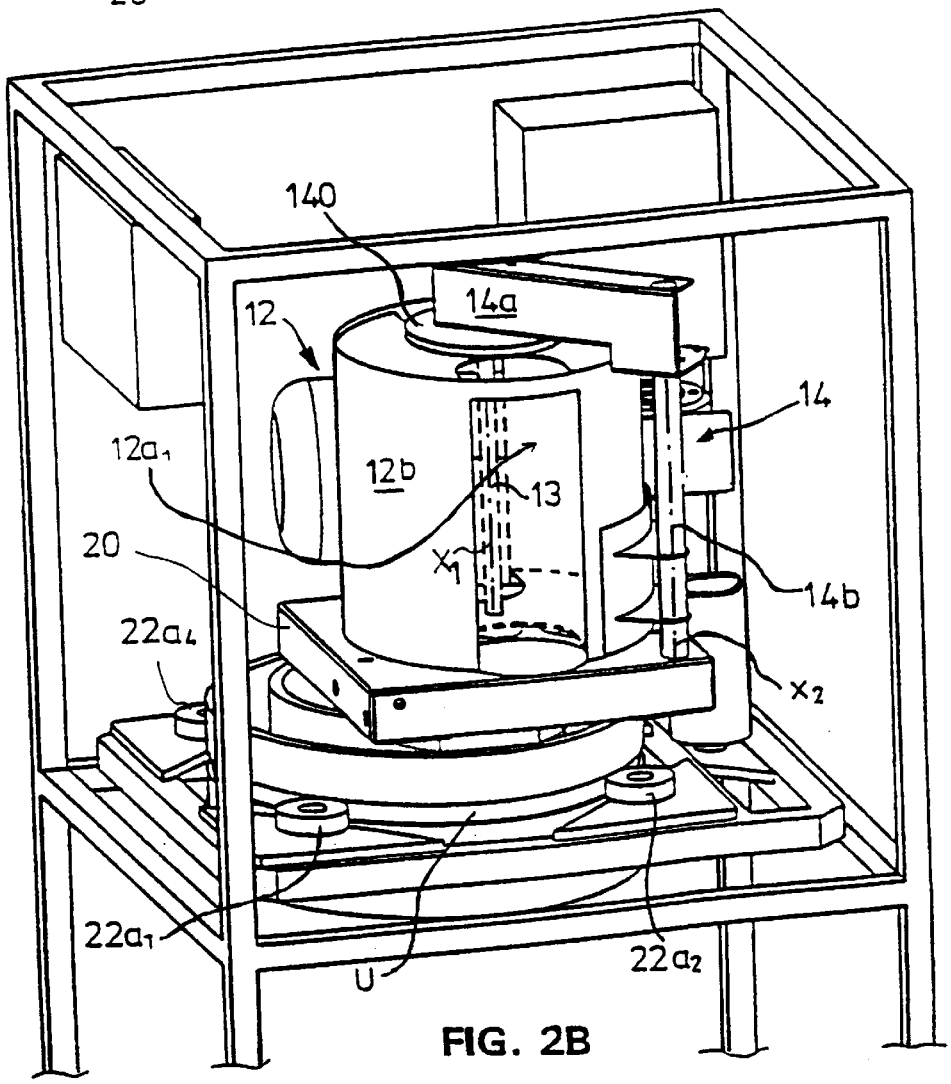
FIG. 2B is an overall illustration of the solution of equipment.

FIG. 2B is an axonometric view of the equipment in accordance with the invention as a whole. The magazine 12 is suspended by means of the shaft 13 on the arm 14. The arm 14 comprises a vertical arm portion 14$b$, which is connected with a horizontal arm portion 14$a$, on which the shaft 13 is suspended. The shaft 13 is connected with a drive pulley 140, by whose means the shaft 13 and the connected magazine 12 are rotated by the motor $M_1$. The scanner 200 is fitted in the station $B_2$ shown in the figure and placed at the side. The lower package processing device 15, preferably a press, comprises a press drum 16, which is provided with a groove U, in which the bearing wheels 22$a_1$,22$a_2$, 22$a_3$,22$a_4$ are fitted, which bearing wheels further rest on the machine frame R and whose function is to journal the drum 16 so that it revolves and to control the rotation of said drum 16. The inner drum 17 is a drum 17 rotated by the motor $M_2$. The rotation drive is transferred from the drive drum 17 by means of friction contact to the outside drum 16.

Figure 3A:
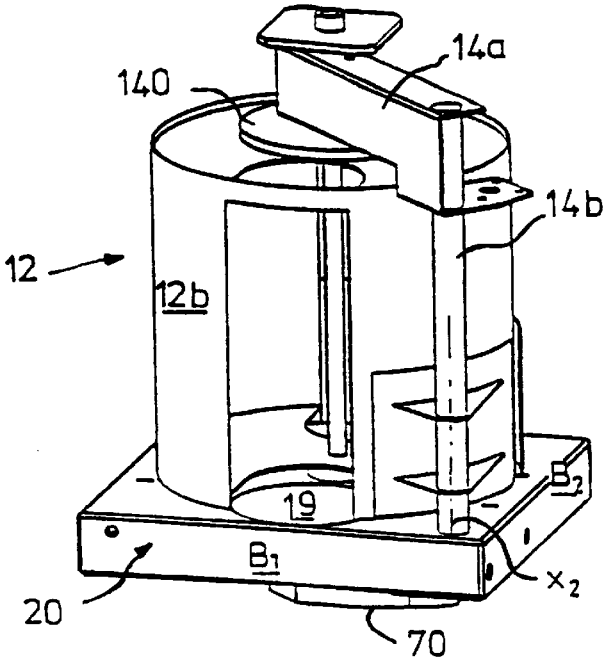
FIG. 3A is a separate illustration of the magazine equipment.

FIG. 3A shows the magazine on an enlarged scale. In view of clarification of the illustration and in order to show the inside constructions of the magazine 12, the curved wall 12$a_1$ has been omitted in the illustration in the figure. The arm 14$a$ is connected with the base plate 20 by means of an articulated joint so that the arm 14$a$ can be rotated around the vertical axis $X_2$, and so also the horizontal arm portion 14$b$ on the arm 14$a$ and the guide wall 12$c_1$.

Figure 3B:
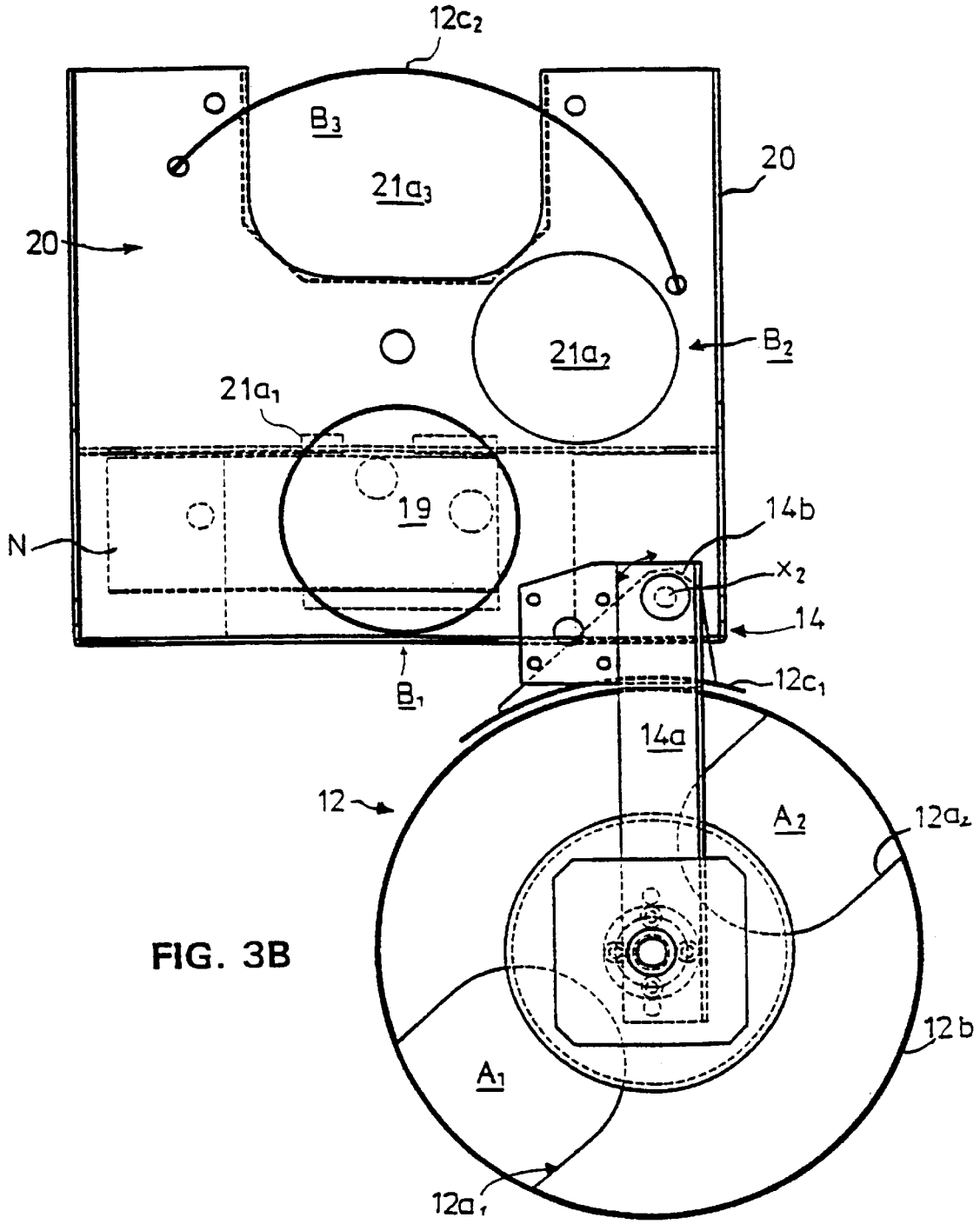
FIG. 3B shows the solution of equipment of FIG. 3A viewed from above, and the magazine is shown as pivoted apart from the base plate for washing or conditioning.

As is shown in FIG. 3B, the arm 14$a$,14$b$ has been rotated into a position in which the magazine 12 has been transferred away from the base plate 20. In such a case, any blocking and contaminations can be removed from the device. FIG. 3B further shows the guide walls 12$c_1$ and 12$c_2$, by whose means the returned package in the space $A_1$ or $A_2$ is kept in said space during the transfers between the stations $B_1$,$B_2$ and $B_3$. FIG. 3B further shows the openings 21$a_1$,21$a_2$ and 21$a_3$. In the opening 21$a_2$ the disk 18 is fitted, by whose means the returned package is rotated. In the opening 21$a_1$ the measurement base 19 is fitted, which is mounted by means of a hinge 190 so as to pivot against the spring force of a spring/springs 191, in which case, by means of a limit switch 192, information is supplied to the central unit 100 when a full returned package has been placed on the measurement base 19. In such a case the returning is not accepted.

As is shown in FIG. 3B, the base plate 20 includes an opening 21$a_1$ in the station $B_1$, which opening is covered by a pivotal/inclinable measurement plate 19, and an opening 21$a_2$ in the station $B_2$, which is covered by the rotated scanning disk 18. In the station $B_3$ there is an opening 21$a_3$, through which the returned package falls down into the press 15 placed below, into the space between the press drums 16 and 17, from which space the returned package enters into the gap $N_1$ between the drums 16 and 17 and is compressed into smaller volume. The opening 21$a_3$, i.e. the dropping space, is defined from the side by a curved guide wall 12$c_2$. As is shown in FIG. 3B, a curved guide wall 12$c_1$ is further connected with the vertical arm 14$b$, in which case the wall turns along with the turning of the arm 14$a$.

Figure 3C:
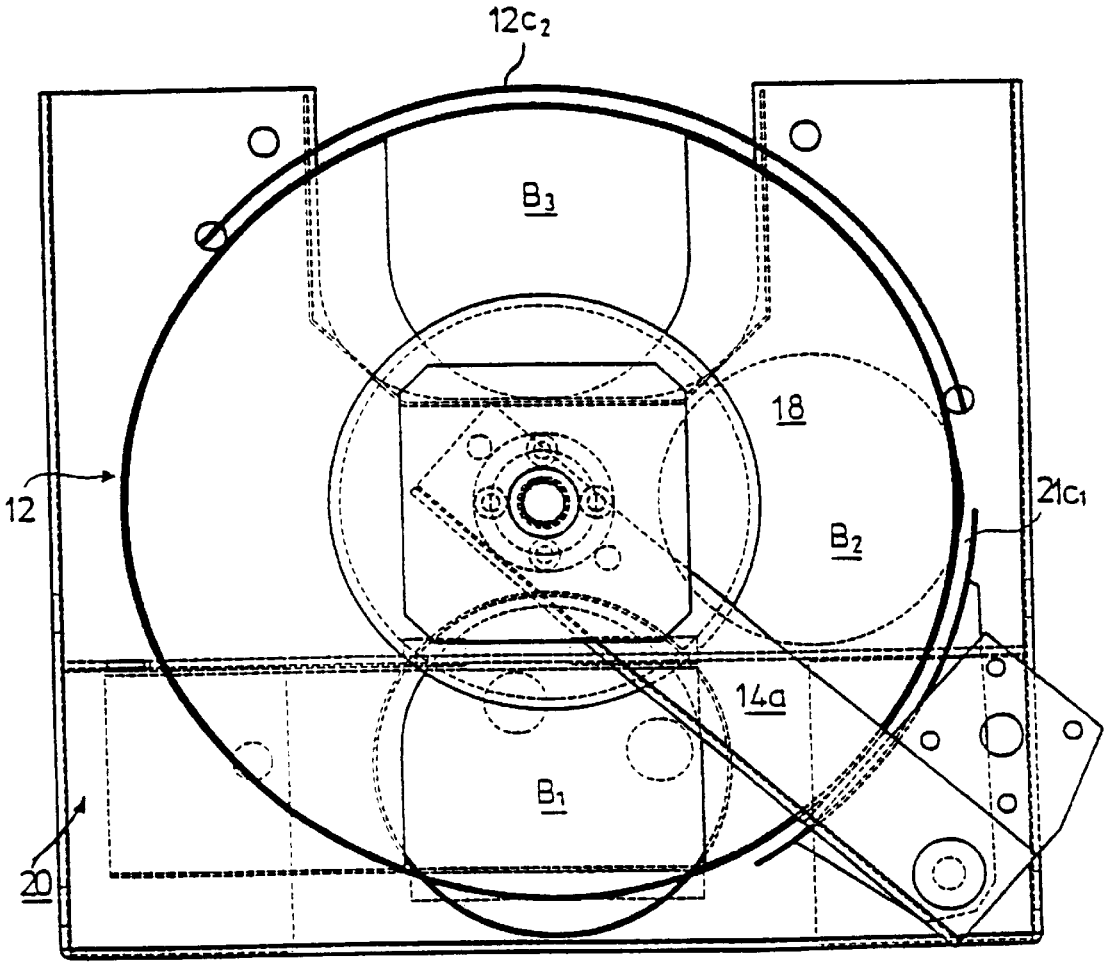
FIG. 3C shows the construction of FIG. 3B in its position of operation, in which the magazine has been pivoted on the support of an arm onto the base plate.

In FIG. 3C the arm 14$a$ has been turned back into the operating position, in which case the magazine 12 is placed on the base plate 20. Thus, the magazine 12 can be pivoted on the arm 14$a$, 14$b$ in relation to the base plate 20.

Figure 4:
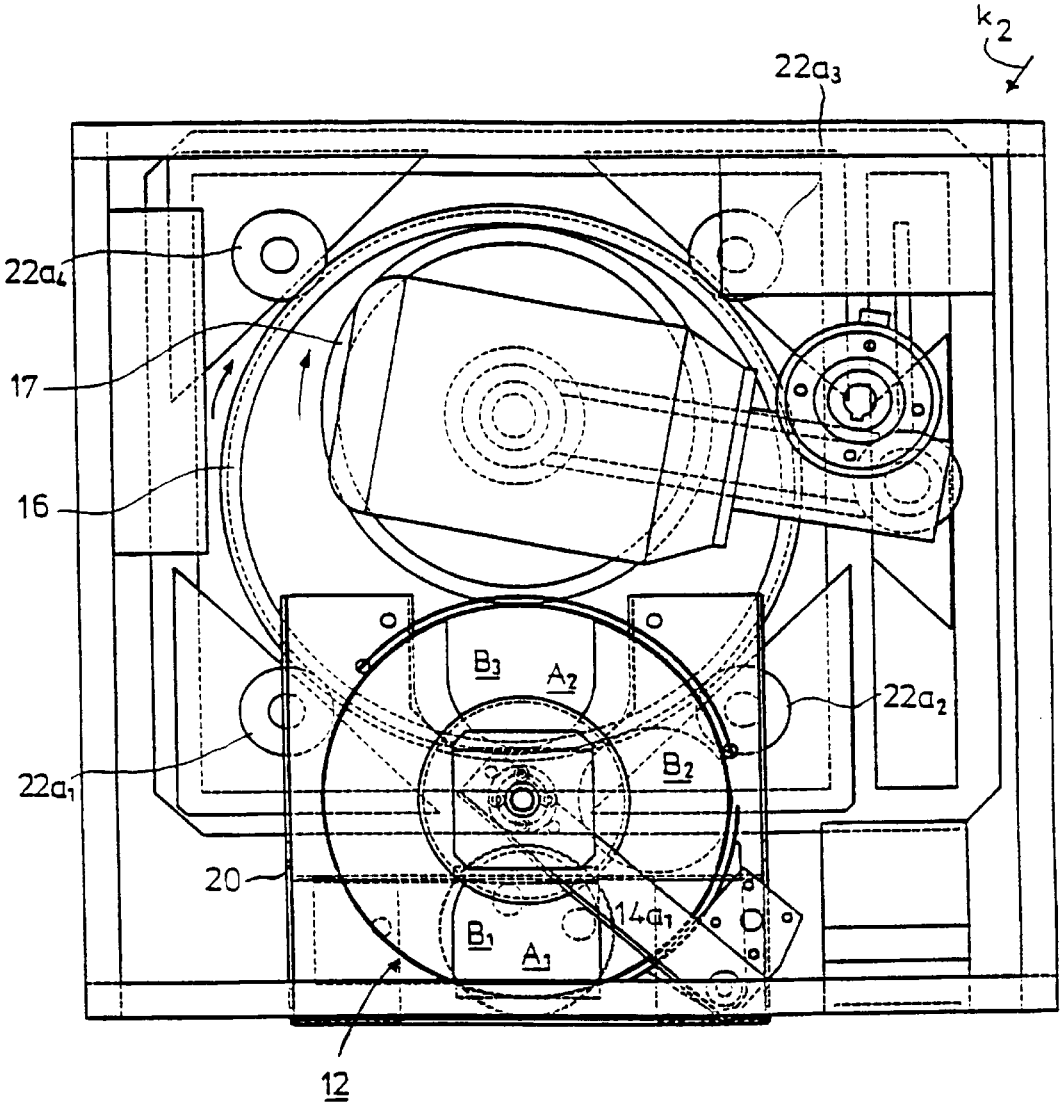
FIG. 4 is a schematic top view of the magazine and of the press device placed below the magazine.

FIG. 4 illustrates the overall construction in accordance with the invention viewed from above. The spaces $A_1$ and $A_2$ in the magazine 12 are placed one opposite to the other in the magazine, and in the plate 20 the device comprises a feed station $B_1$, a scanning station (code reading station) $B_2$ and a dropping station $B_3$. When the magazine 12 is rotated so that the package space $A_1$ moves from the station $B_1$, to the station $B_2$, the wall 12$b$ of the magazine 12 moves to close the feed station $B_1$, in which connection, at the scanning stage, a new returnable package cannot be fed into the package space $A_1$ or $A_2$ in the magazine 12. Then the wall 12$b$, preferably a curved wall, closes the feed station or feed gate $B_1$ and blocks the feed gate $B_1$.

Figure 5A:
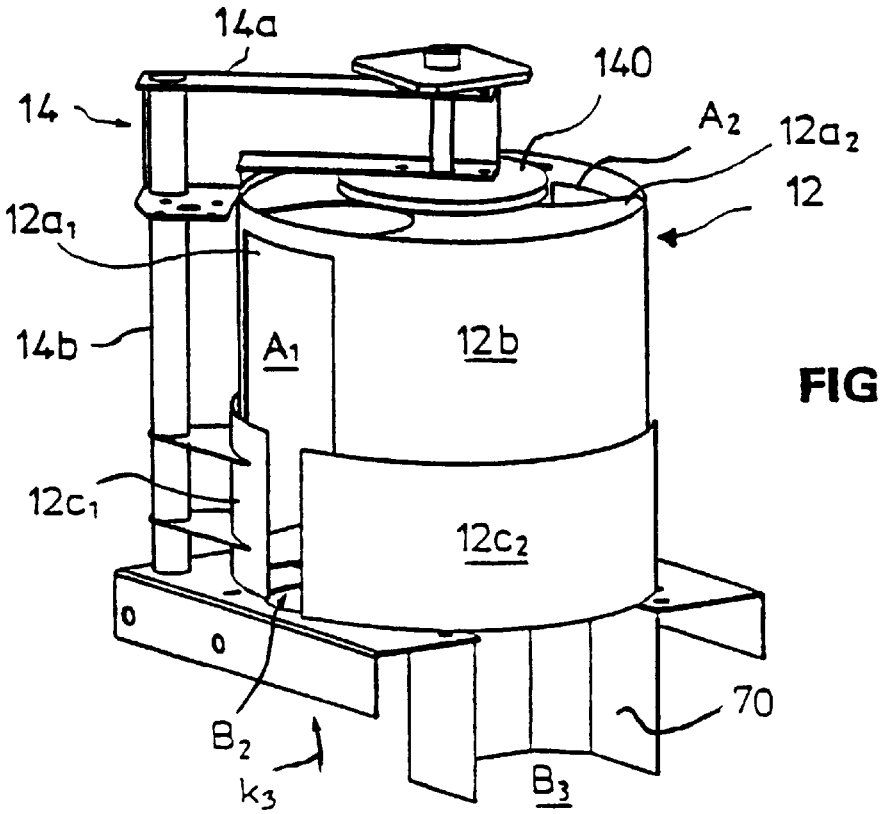
FIG. 5A shows the construction of FIG. 4 seen mainly in the direction of the arrow $k_2$ in FIG. 4. The illustration is axonometric.

FIG. 5A shows the solution of equipment of FIG. 4 viewed in the direction of the arrow $k_2$ in FIG. 4. The dropping opening 21$a_3$ includes a guide plate 70, by whose means, in the dropping station $B_3$ after the package code reading, the returned package can be guided into the package processing device 15, preferably a press.

Figure 5B:
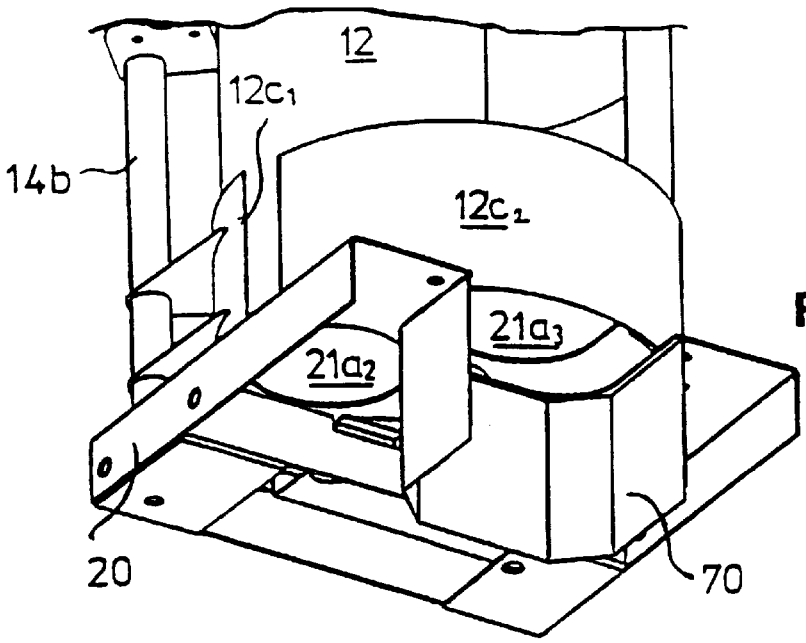
FIG. 5B shows the solution of equipment of FIG. 5A viewed in the direction of the arrow $k_3$ in FIG. 5A.

FIG. 5B shows the solution of equipment shown in FIG. 5A viewed in the direction of the arrow $k_3$ in FIG. 5A. In order to illustrate the plate construction 20 shown in the figure, the scanning disk 18 has been removed from the station $B_2$. The guide 70 is fitted to surround the dropping opening 21$a_3$ from underneath.

Figure 5C:
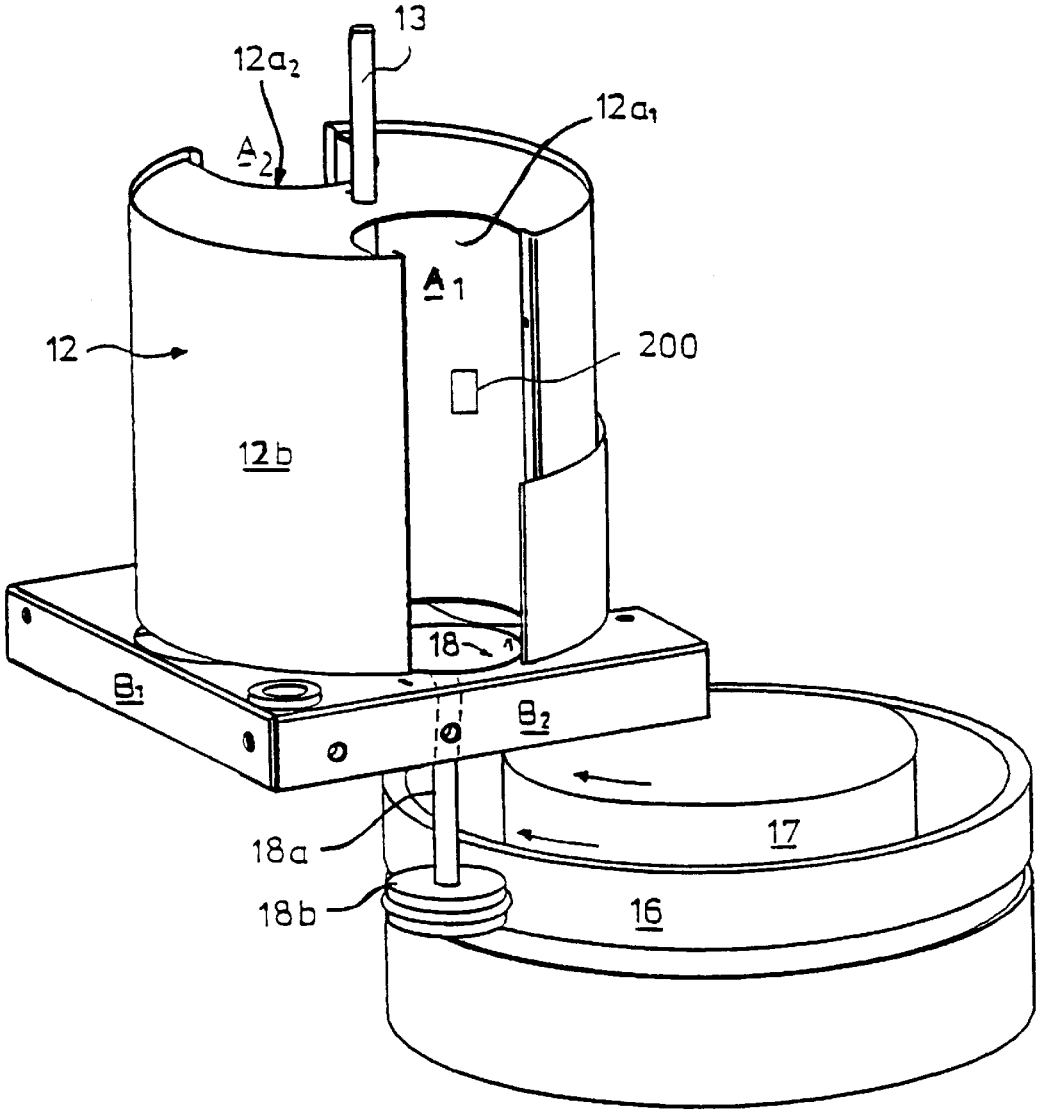
FIG. 5C illustrates the mechanisms of rotation of the disk used for scanning, the rotation drive being taken from the press drum.

FIG. 5C shows a scanning disk 18 placed in the station $B_2$. The rotatable scanning disk 18 is connected with an arm 18$a$, which is provided with a drive wheel 18$b$, preferably a friction wheel, which is fitted to be placed against the outer rotated drum 16 of the press 15. The drive of the drum 16 is taken from the drum 17, which is pressed against the inner face of the drum 16. The drum 17 is rotated by the motor $M_2$.

Figure 6B:
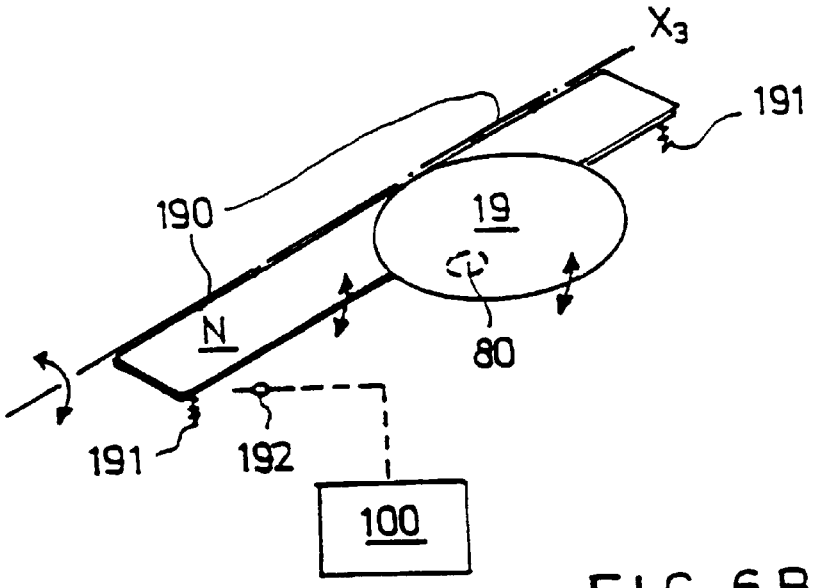
FIG. 6B illustrates the principle of operation of the weight sensing.
Figure 6A:
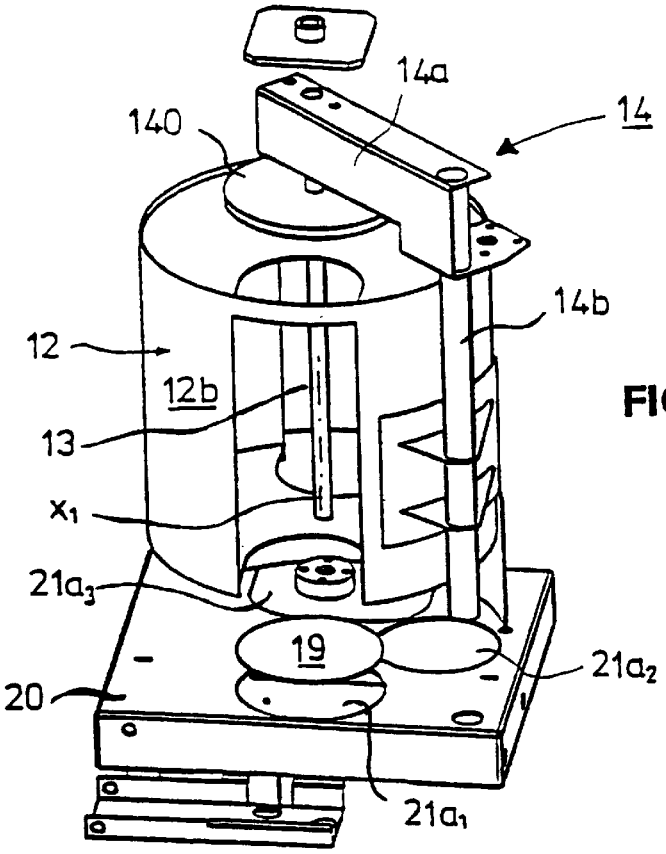
FIG. 6A illustrates a separate rotatable bottom part placed in connection with the base plate, by means of which bottom part the weight of the returned package is detected in the feed station.

FIG. 6A is a separate illustration of the measurement base 19, preferably a circular disk, placed in the station $B_1$. In view of clarifying the illustration and showing the interior constructions in the magazine 12, the curved wall 12$a_1$ has been removed in the illustration in this figure. As is shown in FIG. 6B, the disk 19 is provided with a hinge so as to pivot in a situation in which a full package is fed into the feed station $B_1$. In such a case a limit switch 192 provides the information to the central unit 100, in which case the returned package is not accepted for further transfer by means of the magazine 12.

The dashed line illustrates a detector 80 placed below the disk 19, by means of which detector 80 the material of the package can be identified. The central unit 100 accepts the material or rejects it. In a case of rejection, the returned package is not processed, but it is allowed to remain in the feed station $B_1$. The disk 19 is preferably made of a plastic material.

The circular disk 19 is fixedly connected with a rectangular plate portion N. The plate N is mounted by means of a number of hinges 190 on the frame R of the device, for example the base plate 20. Thus, the measurement disk 19 is fitted to pivot on support of the plate N around the axis $X_3$. The spring devices 191 have been fitted, for example, so that they act upon the plate N at its edge, or said spring devices can have been fitted directly on the shafts of the hinge devices 190. The limit switch 192 is fitted at a distance from the plane of the plate N when a weight does not act upon the measurement base 19. When an excessively heavy, for example full, can is placed on the measurement disk 19, the plate N is pivoted and starts acting upon the limit switch 192, from which the information is passed to the central unit 100, and the package is not accepted. In such a case the light $C_1$ in the front panel of the device is switched on, which is an indication for the returning person to the effect that the returnable package should be removed from the feed station $B_1$.

The equipment can also include a device $C_2$ which produces a sound signal, in which case, in a rejection case, both a sound signal and a light signal are given.

What is claimed is:

1. A device for handling returnable packages including a feed station at which the packages are placed into the device through an opening in a frame of the device and an identification station at which the packages are identified, comprising a rotatable magazine for transferring the package from the feed station to the identification station and from the identification station to an acceptance stations said magazine having a generally cylindrical outer wall and defining at least one package space in said outer wall for receiving a package, rotation means for rotating said magazine between a first position in which said package space is in the feed station and receivable of a package and a second position in which said outer wall closes the opening in the frame and said package space is in the identification station, control means coupled to said rotation means for controlling rotation of said magazine by said rotation means, and identification means structured and arranged to identify a package in said package space when said package space is in the identification station and determine if the package is acceptable or not acceptable, said control means being coupled to said identification means and being structured and arranged to rotate said magazine and thus said package space into said acceptance station if the package is acceptable and back to the feed station if the package is unacceptable where said package is accessible to a user to enable the user to remove the package from said feed station.

2. The device of claim 1, further comprising pressing or crushing means for pressing or crushing packages arranged to receive packages from the acceptance station, and means defining a storage space, the crushed or pressed packages being transferred from said pressing or crushing means into said storage space.

3. The device of claim 1, wherein said magazine comprises an inwardly directed arcuate wall extending from said outer wall, said package space being defined by said arcuate wall.

4. The device of claim 1, wherein said identification means comprises a scanner structured and arranged to read a bar code on the package when the package is situated in said package and said package space is in the identification station.

5. The device of claim 1, wherein said magazine comprises a central shaft about which said magazine is rotated, said rotation means comprising a drive wheel coupled to said shaft and a motor coupled to said drive wheel for rotating said drive wheel to thereby rotate said shaft and thus said magazine, the device further comprising a base plate, a suspension device for suspending said magazine over said base plate, said suspension device comprising a horizontal arm connected to said shaft and a vertical arm connected to said horizontal arm, said vertical arm being rotatably coupled to said base plate such that said suspension device is structured and arranged to enabling the lifting of said magazine away from said base plate during servicing of said device.

6. The device of claim 1, further comprising a base plate over which said magazine is positioned, and a front panel including a signal lamp coupled to said control means, means for measuring the weight of said package comprising a measurement disk operably mounted to said base plate and arranged in the feed station such that when said package space is in the feed station and a package is situated in said package space, the package is situated on said measurement disk, a hinge device on which said measurement disk is pivotally mounted, a spring arranged to resist pivoting of said measurement disk and a limit switch coupled to said control means for detecting pivoting of said measurement disk such that when a full package is placed in said package space when in the feed station, said limit switch is activated indicating a non-acceptable package and directs information on the non-acceptable package to said control means and said control means switch on said signal lamp.

7. The device of claim 1, further comprising a base plate over which said magazine is positioned, a rotatable disk operably mounted to said base plate and arranged in the identification station such that when said package space is in the identification station and a package is situated in said package space, the package is situated on said disk, and disk rotation means for rotating said disk.

8. The device of claim 1, wherein said magazine is rotated by said rotation means around a central axis and the feed station and the identification station are defined at an angular distance of 90° from one another.

9. The device of claim 1, further comprising a base plate over which said magazine is positioned, and pressing or crushing means for pressing or crushing packages arranged to receive packages from the acceptance station, said base plate including an opening in the acceptance station such that when said package space is in the acceptance station and a package is situated in said package space, the package is passed through said opening into said pressing and crushing means, the acceptance station being situated opposite the feed station.

10. The device of claim 1, further comprising a base plate over which said magazine is positioned, a rotatable disk operably mounted to said base plate and arranged in the identification station such that when said package space is in the identification station and a package is situated in said package space, the package is situated on said disk, a shaft connected to said disk, and a drive wheel mounted on said shaft wherein said pressing and crushing means comprise a first substantially circular drum and a second substantially circular drum having a smaller diameter than said first drum and being arranged inside said first drum, and a motor for rotating said first and second drums, said drive wheel being pressed into contact with one of said first and second drums such that rotation of said one of said first and second drums causes said drive wheel, said shaft and thus said disk to rotate.

11. The device of claim 1, wherein said drive wheel comes into contact with said first drum.

12. The device of claim 1, wherein said magazine includes first and second package spaces, and said rotation means for rotating said magazine is operable to rotate said first and second package spaces between said first position in which said first package space is positioned in said feed station, said second position where said outer wall closes the opening in the frame and said first package space is positioned in said identification station and a third position in which said first package space is positioned at said acceptance station and said second package space is simultaneously positioned in said feed station.

13. The device of claim 1, further comprising means for weighing said package and determining if said package is of an admissible or inadmissible weight, said means for weighing arranged in said feed station.

14. The device of claim 13, wherein said means for weighing said package is coupled to said control means and said control means being structured and arranged to rotate said magazine to said identification station if said package is of an admissible weight.

15. A method for handling a returnable package such as a bottle or can, comprising the steps of:

inserting the package in a feed station into a package space defined in an outer wall of a rotatable magazine, weighing the package in the feed station, and only if the weight of the package is acceptable, transferring the package into an identification station by rotating the magazine such that the feed station is closed by the outer wall of the magazine, identifying the package in the identification station, and only if the package identification is not acceptable, transferring the package back to the feed station by rotating the magazine so that said package is accessible to be removed from said feed station.

16. The method of claim 15, further comprising the step of:

only if the package identification is acceptable, transferring the package into a pressing or crushing device.

17. The method of claim 15, wherein the package space is defined by an inwardly directed wall extending from an outer wall of the magazine, and wherein the step of transferring the package by rotating the magazine is effectuated by a motor operably connected to said magazine.

18. The method of claim 16, wherein the package includes a bar code, the step of identifying the package comprising the step of reading the bar code on the package by means of a scanner, the step of transferring the package into the identification station comprising the step of moving the package onto a scanning disk, further comprising the step of:

rotating the scanning disk by means of a motor of the pressing or crushing device.

19. The method of claim 18, wherein the pressing or crushing device comprises a press drum rotated by the motor, wherein the scanning disk is coupled at one end of a shaft, and a drive wheel is coupled at another end of the shaft, and wherein the step of rotating the scanning disk by means of the motor of the pressing or crushing device comprises the step of pressing the drive wheel into contact with the press drum.

20. The method of claim 15, further comprising the step of switching a visible signal light on if the weight of the package is unacceptable or the identification of the package is unacceptable.

21. The method of claim 15, further comprising the step of producing a sound signal if the weight of the package is unacceptable or the identification of the package is unacceptable.

22. The method of claim 15, further comprising the step of rotating the magazine such that the outer wall closes the feed station if a failure operation occurs.

* * * * *